United States Patent [19]

Sekine

[11] 4,310,101

[45] Jan. 12, 1982

[54] COMBINED BOTTLE AND SCREW CAP ASSEMBLY

[75] Inventor: Shigeo Sekine, Tokyo, Japan

[73] Assignee: Max Factor & Company, Hollywood, Calif.

[21] Appl. No.: 123,342

[22] Filed: Feb. 21, 1980

[51] Int. Cl.[3] ..... B65D 41/04; B65D 53/04

[52] U.S. Cl. ..... 215/330; 215/331; 215/342; 215/350

[58] Field of Search ..... 215/330, 331, 217, 216, 215/341, 342, 350, 351

[56] References Cited

U.S. PATENT DOCUMENTS

| | | | |
|---|---|---|---|
| 2,681,742 | 6/1954 | Miller | 215/350 |
| 2,684,168 | 7/1954 | McGinnis | 215/330 |
| 2,732,089 | 1/1956 | Frydlender | 215/342 |
| 3,088,616 | 5/1963 | Freda | 215/342 |
| 3,331,523 | 7/1967 | Exton | 215/350 |
| 3,581,926 | 6/1971 | Roder | 215/330 |
| 4,093,096 | 6/1978 | Augros | 215/330 |

*Primary Examiner*—Donald F. Norton

*Attorney, Agent, or Firm*—Flehr, Hohbach, Test et al.

[57] ABSTRACT

A container assembly including a bottle and cap arrangement is disclosed herein along with a cooperating arrangement for placing the cap arrangement in a predetermined closed position relative to the bottle. The assembly also includes a seal arrangement for maintaining a proper seal when the bottle is closed.

18 Claims, 4 Drawing Figures

COMBINED BOTTLE AND SCREW CAP ASSEMBLY

This invention relates generally to a combined bottle and cap assembly and more particularly to an assembly in which the bottle is maintained in a satisfactorily sealed condition while controlling the maximum screwed-on position of its screw cap with respect to its bottle.

An increased number of container assemblies including bottles of non-circular shape (as seen in a plane) and associated screw caps have been employed to provide a novel design effect.

In a container of this type, one of the most difficult problems has been to position the cap on the bottle in a predetermined maximum screwed-on position while maintaining a satisfactory seal. For example, the cap and its associated packing (sealing means) could be designed and formed so that the bottle and cap can assume a satisfactory positional relationship in the peripheral direction. At the same time, the packing is assembled to the cap so as to firmly press against the mouth of the bottle with a high degree of force for providing a satisfactory seal by screwing the screw cap onto the bottle to a specific seal closing position. However, even in this case, the specific position of the cap originally provided to maintain the bottle sealed with a high degree of force may shift (more or less) due to deformations which may be caused by slight errors in forming the threads on the bottle and cap and/or fatigue to the cap and packing. This, in turn, may cause a misalignment between the cap and bottle which may adversely affect the seal therebetween.

In order to eliminate the difficulty just recited, there has been proposed an arrangement in which the bottle and cap are provided with means for controlling the relative rotational position of the cap with respect to the bottle so that the bottle and cap are maintained immovable in the maximum screwed-on position of the cap with respect to the bottle. However, even in an arrangement of this type, where only the rotational position of the cap is controlled with respect to the bottle, the recited problem is not eliminated, that is, the sealing action of the cap acting on the bottle may be reduced as a result of an error in forming the components making up the arrangement as well as fatigue and deformation of the components.

Therefore, an object of the present invention is to eliminate the problems and disadvantages inherent in the prior art combined bottle and cap arrangements referred to hereinabove by the use of an arrangement in which there is provided between the bottle and cap means for controlling the screwed-on position of the cap on the bottle in a particular way. Specifically, the cap is allowed to displace vertically by a distance greater than that attained previously, while at the same time, maintaining the sealing action of the packing against the bottle.

One embodiment of the container assembly of the present invention will now be described with reference to the accompanying drawings in which.

Figure 2:
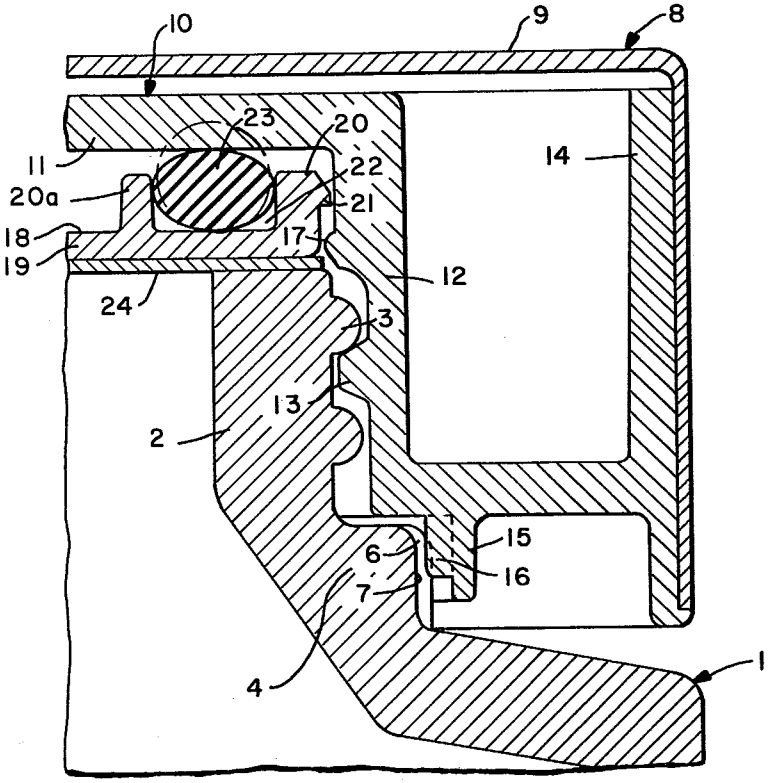
FIG. 2 is an enlarged vertical sectional view of a portion of the container assembly taken generally along line B—B in FIG. 3.

The present invention provides a container assembly including a bottle 1 having a cap postion control portion to be described hereinafter and a cap arrangement which includes an internally threaded inner cap 10 having a packing arrangement 18 assembled thereto and an outer cap 9.

The bottle 1 has a neck 2 (e.g. a top end section) provided on the outer periphery thereof with external threads 3 and a shoulder 4 which connects between the main body of the bottle and the base of the neck 2 to limit the threaded engagement or screwed-on position of the cap arrangement 8 with respect to the bottle 1.

Figure 4:
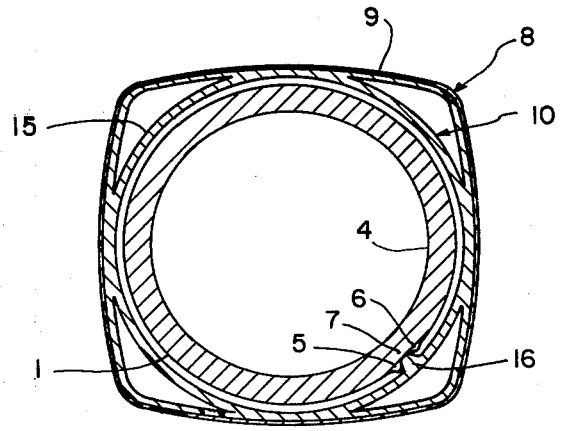
FIG. 4 is a plan cross-sectional view of the overall assembly in the plane including an alignment rib comprising part of the cap.

For reasons to be described hereinafter, the outer periphery of shoulder 4 is provided with a radially and outwardly extending projection 6 and a second radially and outwardly extending projection 5 which is spaced from projection 6 in the rotational direction of the cap 8 as the latter is screwed onto the neck 2. The second projection 5 extends radially and outwardly by a distance greater than that of projection 6, as best seen in FIG. 4. A recess 7 is formed between the projections 5 and 6.

Figure 3:
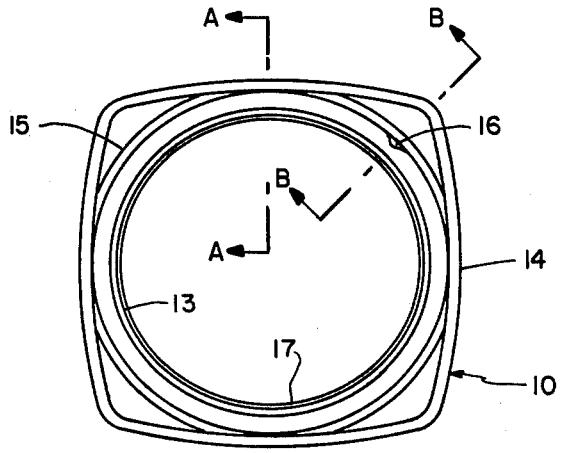
FIG. 3 is a bottom view of a cap arrangement comprising part of the container assembly.

As mentioned hereinabove, the cap arrangement 8 is comprised of the outer cap 9 and inner cap 10 having the packing arrangement 18 assembled thereto. The outer cap 9 which is primarily adapted to give a pleasant appearance to the cap arrangement 8 has a closed top and is of a non-circular shape as seen in FIGS. 3 and 4 (in the illustrated embodiment, the outer cap has a bevelled square shape). The inner cap 10 which is adapted to be firmly fitted in the outer cap 9 is integrally formed and has an inner cylinder 12 including a closed top 11 and internal threads 13 formed on its inner periphery and an outer cylinder 14 integrally connected at the lower end with the lower end of the inner cylinder 12. The outer cylinder 14 has an integral annular leg 15 depending from the lower end of the outer cylinder 14 and adapted to oppose the shoulder 4.

The inner peripheral surface of the depending annular leg 15 is formed with an aligning rib 16 adapted to engage in recess 7 formed in the outer peripheral surface of the shoulder 4 when the cap arrangement 8 is screwed onto the neck 2 to a predetermined maximum screwed-on position. The aligning rib 16 has a height (e.g. projects out) just enough to catch the outermost tip end of projection 6 (which defines the recess 7 in cooperation with the second projection 5). When the rib engages the projection 5, the cap arrangement 8 is prevented from further rotating. At the same time, projection 6 does present some resistance to the cap arrangement with respect to rotation in the opposite opening direction. The inner periphery of the inner cylinder 12 is provided adjacent the upper end thereof with an annular projection 17 which is adapted to engage and hold (e.g. interlock) the packing arrangement 18 in an assembled condition with respect to the inner cap 10 as will be seen below.

Figure 1:
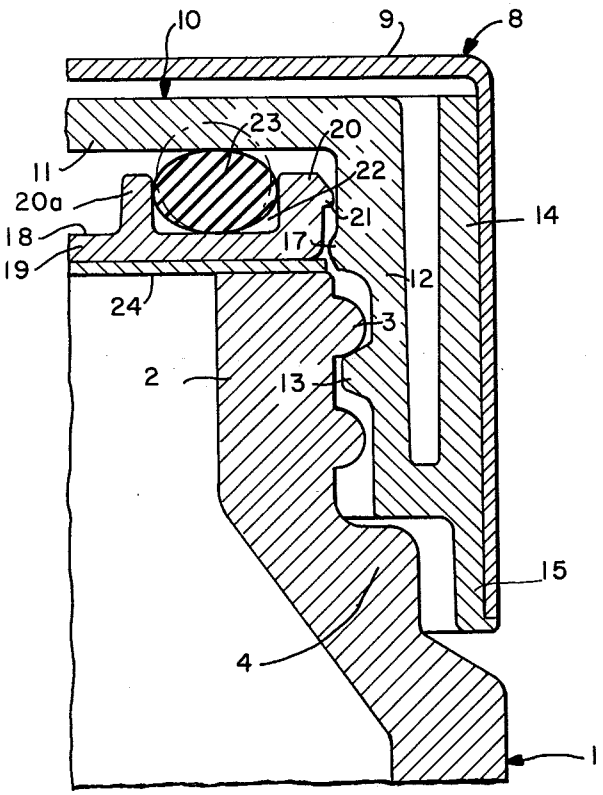
FIG. 1 is an enlarged vertical sectional view of a portion of the container assembly taken generally along line A—A in FIG. 3.

The packing arrangement 18 to be assembled to the inner cap 10 includes a base 19 in the form of a horizontal disc and a pair of spaced and parallel annular projections 20, **20*a* extending upwardly of the base 19 to define a recess 22 for receiving an O-ring 23 therein. The packing arrangement 18 is held in the assembled condition with respect to the inner cap 10 by means of an outer annular projection 21 on projection 20 and projection 17. More specifically, projection 21 engages projection 17 so that the entire packing arrangement 18 is prevented from separating from the inner cap 10 when the entire cap arrangement is separated from the bottle. At the same time, since the outer annular projection 21 is positioned above the projection 17, the packing arrangement 18 is allowed to displace vertically by the distance between the projections 17 and 21 when the cap arrangement is in its predetermined screwed-on position as seen in FIGS. 1 and 2**.

The O-ring 23 is so dimensioned that when the two projections 17 and 21 engage one another, the O-ring 23 slightly contacts the undersurface of the closed top 11 of the inner cylinder 12. However, as the cap assembly 8 is screwed onto the neck 2 of the bottle 1 deeper and deeper, the O-ring comprising part of packing arrangement 18 is resiliently compressed against the upper surface of the neck 2 of the bottle 1 causing it to deform by being compressed between the base 19 of the packing arrangement 18 and top 11 so as to become oval in configuration. This spaces the projection 21 from the projection 17 whereby the base 19 of the packing arrangement 18 is urged against the top of the neck 2 under the resiliency of the O-ring 23. More specifically, the packing arrangement 18 is pressed against the top of the neck 2 with a force which is determined by the resilient deformation of the O-ring 23 in the vertical direction to thereby seal the opening in the neck 2 of the bottle 1. The sealing of the neck opening afforded by the O-ring 23 is not affected in any way even when the screwed-on position of the cap assembly 8 on the bottle 1 varies somewhat, that is, to a limited extent, or the height of the cap arrangement 8 with respect to the bottle 1 varies somewhat, that is, to a limited extent.

Moreover, since the principal object of the outer cap 9 is to give a pleasant appearance to the cap arrangement 8, the outer cap 9 is preferably formed of a metal which has an excellent decorative feature. In addition, since the inner cap 10 is required to have excellent forming and "holding-on-to-the-bottle" features, that is, holding capabilities with respect to the bottle 1, the inner cap 10 is preferably formed of a certain soft synthetic resin. Furthermore, the packing arrangement 18 is preferably formed of a soft synthetic resin which has a high sealing function. However, since the packing arrangement 18 is required to be assembled to the inner cap 10 in such a manner that it is allowed to displace vertically without detaching itself from the inner cap 10, there is a mechanical disadvantage in integrally forming the packing 18 with soft synthetic resin. Thus, according to the present invention, as shown in the illustrated embodiment, it is preferable that the main body of the packing arrangement 18 including the base 19 and annular projections 20, 20*a* be formed of a relatively hard synthetic resin. A packing sheet 24 formed of a relatively soft synthetic resin is secured to the undersurface of the base 19.

With the above-mentioned construction and arrangement of the components of the bottle and cap combination of the present invention, the maximum screwed-on limit of the cap arrangement 8 with respect to the bottle 1 is limited to a predetermined position by the engagement between the aligning rib 16 and projection 5, that is, when rib 16 enters recess 7. In this way, with the bottle 1 in its sealed condition, the bottle 1 and cap arrangement 8 are always maintained in a predetermined rotational position to thereby obtain stable and excellent alignment features. Moreover, even if the vertical position of the packing arrangement 18 varies somewhat when the aligning rib 16 engages in the recess 7 due to distortion caused by error in forming the components and fatigue of the materials of the components, if such a variation is within the elastic deformation capability of the O-ring 23, the sealing action of the packing arrangement 18 with respect to the bottle 1 will not be affected in any way. Hence, in spite of such variation in the position of the packing arrangement 18 in the vertical direction, a good sealing can be maintained on the bottle 1. Furthermore, since the height (or outward extent) of the aligning rib 16 is designed to slightly engage the projection 6, when the aligning rib 16 engages in the recess 7, the rib 16 also engages the projection 6. This in turn eliminates the disadvantage of the cap arrangement 8 rotating inadvertently about the bottle 1 in the unscrewing direction.

In order to allow the aligning rib 16 to perform its function, it is preferably formed at a point on the inner periphery of the depending leg 15 remote from the outer cap 9 by a relatively great distance. This positioning of the aligning rib 16 makes it possible to utilize the resiliency of the depending leg 15 itself to maintain the aligning rib 16 in the engagement relationship with respect to the recess 7.

As clear from the foregoing description of the illustrated and described embodiment of the present invention, the maximum screwed-on position of the cap arrangement 8 with respect to the bottle 1 can be precisely controlled and the bottle 1 can be positively maintained in its sealed condition irrespective of deformation of the components which are caused due to error in forming the components and/or fatigue thereof. Furthermore, there is the advantage that the cap arrangement 8 can be formed by merely fitting the inner and outer caps together. In addition, by controlling the position of cap arrangement 8 relative to bottle 1, the position of outer cap 9 (which is preferably metal or other rigid material) relative to the main body of the bottle can be precisely controlled. In this regard, in a preferred embodiment, the main body of the bottle has a non-circular outer periphery (in plan view) identical to the non-circular shape of outer cap 9, for example a bevelled square shape. In this preferred embodiment, when the cap arrangement is in its maximum screwed-on position, outer cap 9 and the main body of bottle 1 are in alignment with one another so that their respective outer surfaces line up with one another to provide a smooth transition from the bottle to the outer cap. One pair of aligned surfaces is shown in each of the FIGS. 1 and 2.

What is claimed is:

1. A container assembly comprising:

(a) a bottle including a top open end and a cylindrical top end section extending downwardly from said open end, said top end section being provided with external threads;

(b) a cap arrangement including means defining a cylindrical innermost surface containing internal threads which are designed to cooperate with said external threads for screwing down the cap arrangement around the top end section of said bottle for closing its open end and an underside extending across and above said innermost surface;

(c) means for locating said cap arrangement in a predetermined, closed position along the length of the top section of said bottle, said locating means including means forming part of said cap arrangement for providing an internal, radially inwardly extending rib located below said internal threads and means forming part of said bottle for providing an external recess below said external threads so as to receive said rib as said cap arrangement is screwed down into said predetermined closed position, said recess providing means including a first projection extending radially outwardly from and formed on the top section of said bottle below said external threads and a second projection extending radially outwardly from and formed on the top section of said bottle in a position past and extending further out than said first projection in the screw closing direction of rotational movement of said cap arrangement, whereby said recess is defined between said projections; and (d) means for providing a seal around the open end of said bottle between the latter and the underside of said cap arrangement when said cap arrangement is in said predetermined closed position and even if said cap arrangement is in a position around the top end section of said bottle predetermined distances above or below said predetermined closed position.

2. A container assembly according to claim 1 wherein said cap arrangement includes a resilient cylindrical skirt depending downwardly from and connected with said means defining said innermost surface below said internal threads, said skirt carrying said rib on its inner surfaces.

3. A container assembly according to claim 1 wherein said seal providing means and said cap arrangement include cooperating means for interlocking said seal providing means and said cap arrangement when the latter is separated from said bottle.

4. A container assembly according to claim 1 wherein said second projection extends sufficiently far out from said top section for preventing said rib from moving past it whereby to prevent said cap arrangement from being screwed down past said predetermined closed position.

5. A container assembly comprising:

(a) a bottle including a top open end and a cylindrical top end section extending downwardly from said open end, said top end section being provided with external threads;

(b) a cap arrangement including means defining a cylindrical innermost surface containing internal threads which are designed to cooperate with said external threads for screwing down the cap arrangement around the top end section of said bottle for closing its open end;

(c) means for locating said cap arrangement in a predetermined closed position along the length of the top section of said bottle, said locating means including means forming part of said cap arrangement for providing an internal, radially inwardly extending rib located below said internal threads and means forming part of said bottle for providing an external recess below said external threads so as to receive said rib as said cap arrangement is screwed down into said predetermined closed position, said recess providing means and said rib cooperating with one another for making it more difficult to screw down said cap arrangement past said predetermined position than to unscrew the cap arrangement from said predetermined position, and said recess providing means including a first projection extending radially outwardly from and formed on the top section of said bottle below said external threads and a second projection extending radially outwardly from and formed on the top section of said bottle in a position past said first projection in the screw closing direction of rotational movement of said cap arrangement, whereby said recess is defined between said projections, said second projection extending out from said top section further than said first projection for making it more difficult to screw down said cap arrangement past said predetermined closed position than to unscrew the cap from the same position; and (d) means for providing a seal around the open end of said bottle between the latter and said cap arrangement when said cap arrangement is in said predetermined closed position.

6. A container assembly according to claim 5 wherein said second projection extends sufficiently far out from said top section for preventing said rib from moving past it whereby to prevent said cap arrangement from being screwed down past said predetermined closed position.

7. A container assembly according to claim 5 wherein said cap arrangement includes a resilient cylindrical skirt depending downwardly from and connected with said means defining said innermost surface below said internal threads, said skirt carrying said rib on its inner surface.

8. A container assembly according to claim 5 wherein said cap arrangement includes a rigid outer cap having an outermost cross-sectional periphery which is non-circular in configuration.

9. A container assembly according to claim 5 wherein said cap arrangement includes an underside extending across and above said innermost surface and wherein said seal providing means includes a resilient O-ring and seal means located over the open end of said bottle supporting said O-ring above said open end such that the O-ring engages the underside of said cap arrangement when the latter is in said predetermined closed position in order to cause said seal means to seal closed said open end.

10. A container assembly according to claim 9 wherein said O-ring is dimensioned to engage said underside to provide said sealing even if said cap arrangement is in a position around the top end section of said bottle predetermined distances above or below said predetermined closed position.

11. A container assembly according to claim 10 wherein said seal means supporting said O-ring and said cap arrangement include cooperating means for interlocking said seal means and the supported O-ring to said cap arrangement when the latter is separated from said bottle.

12. A container assembly according to claim 5 wherein said cap arrangement includes an underside extending across and above said innermost surface and wherein said seal providing means includes a disc shaped sealing means adapted to sit on the top of the top end of said bottle across the top open end of the latter, said disc shaped sealing means including means defining an upwardly facing annular channel and radially outwardly extending hook means, a resilient O-ring positioned within and extending upwardly beyond said channel for engaging said underside when said cap arrangement is in said predetermined closed position or even if said arrangement is in a position around the top end section of said bottle predetermined distances above or below said predetermined closed position whereby to cause said disc-shaped sealing means to seal close said open end, said cap arrangement including hook means interconnected with said last-mentioned hook means in order to interlock said disc-shaped support means and O-ring with said cap arrangement while allowing limited axial movement of the disc-shaped support means and O-ring relative to the cap arrangement.

13. A container assembly according to claim 5 wherein said cap arrangement includes a rigid outer cap having an outermost cross-sectional periphery which is non-circular in configuration, wherein said bottle includes a main body having an outermost cross-sectional periphery substantially identical to the outermost cross-sectional periphery of said outer cap, and wherein said peripheries are in alignment with each other when said cap arrangement is in said predetermined closed position.

14. A container assembly comprising:

(a) a bottle including a top open end and a cylindrical top end section extending downwardly from said open end, said top end section being provided with external threads;

(b) a cap arrangement including means defining a cylindrical innermost surface containing internal threads which are designed to cooperate with said external threads for screwing down the cap arrangement around the top end section of said bottle for closing its open end, said cap arrangement also including an underside extending across and above said innermost surface;

(c) means for locating said cap arrangement in a predetermined closed position along the length of the top section of said bottle, said locating means including means forming part of said cap arrangement for providing an internal, radially inwardly extending rib located below said internal threads and means forming part of said bottle for providing an external recess below said external threads so as to receive said rib as said cap arrangement is screwed down into said predetermined closed position, said recess providing means and said rib cooperating with one another for making it more difficult to screw down said cap arrangement past said predetermined position than to unscrew the cap arrangement from said predetermined position; and (d) means for providing a seal around the open end of said bottle between the latter and said cap arrangement when said cap arrangement is in said predetermined closed position, said seal providing means including a resilient O-ring and seal means located over the open end of said bottle supporting said O-ring above said open end such that the O-ring engages the underside of said cap arrangement when the latter is in said predetermined closed position in order to cause said seal means to seal closed said open end.

15. A container assembly according to claim 14 wherein said O-ring is dimensioned to engage said underside to provide said sealing even if said cap arrangement is in a position around the top end section of said bottle predetermined distances above and below said predetermined closed position.

16. A container assembly comprising:

(a) a bottle including a top open end and a cylindrical top end section extending downwardly from said open end, said top end section being provided with external threads;

(b) a cap arrangement including means defining a cylindrical innermost surface containing internal threads which are designed to cooperate with said external threads for screwing down the cap arrangement around the top end section of said bottle for closing its open end, said cap arrangement also including an underside extending across and above said innermost surface;

(c) means for locating said cap arrangement in a predetermined closed position along the length of the top section of said bottle, said locating means including means forming part of said cap arrangement for providing an internal, radially inwardly extending rib located below said internal threads and means forming part of said bottle for providing an external recess below said external threads so as to receive said rib as said cap arrangement is screwed down into said predetermined closed position, said recess providing means and said rib cooperating with one another for making it more difficult to screw down said cap arrangement past said predetermined position than to unscrew the cap arrangement from said predetermined position; and (d) means for providing a seal around the open end of said bottle between the latter and said cap arrangement when said cap arrangement is in said predetermined closed position, said seal providing means including a resilient O-ring and seal means located over the open end of said bottle supporting said O-ring above said open end such that the O-ring engages the underside of said cap arrangement when the latter is in said predetermined closed position in order to cause said seal means to seal closed said open end, said O-ring being dimensioned to engage said underside to provide said sealing even if said cap arrangement is in a position around the top end section of said bottle predetermined distances above and below said predetermined closed position, said seal means supporting said O-ring and said cap arrangement including cooperating means for interlocking said seal means and the supported O-ring to said cap arrangement when the latter is separated from said bottle.

17. A container assembly comprising: a bottle including a top open end and a cylindrical top end section extending downwardly from said open end, said top end section being provided with external threads; a cap arrangement including means defining a cylindrical innermost surface containing internal threads which are designed to cooperate with said external threads for screwing down the cap arrangement around the top end section of said bottle for closing its open end; means for locating said cap arrangement in a predetermined closed position along the length of the top section of said bottle, said locating means including means forming part of said cap arrangement for providing an internal, radially inwardly extending rib located below said internal threads and means forming part of said bottle for providing an external recess below said external threads so as to receive said rib as said cap arrangement is screwed down into said predetermined closed position, said recess providing means and said rib cooperating with one another for making it more difficult to screw down said cap arrangement past said predetermined position than to unscrew the cap arrangement from said predetermined position; and means for providing a seal around the open end of said bottle between the latter and said cap arrangement when said cap arrangement is in said predetermined closed position; said cap arrangement including an underside extending across and above said innermost surface and in said seal providing means including a disc-shaped sealing means adapted to sit on the top of the top end section of said bottle across the top open end of the latter, said disc-shaped sealing means including means defining an upwardly facing annular channel and radially outwardly extending hook means, a resilient O-ring positioned within and extending upwardly beyond said channel for engaging said underside when said cap arrangement is in said predetermined closed position or even if said arrangement is in a position around the top end section of said bottle predetermined distances above and below said predetermined closed position whereby to cause said disc-shaped sealing means to seal close said open end, said cap arrangement also including hook means interconnected with said last-mentioned hook means in order to interlock said disc-shaped support means and O-ring with said cap arrangement while allowing limited axial movement of the disc-shaped support means and O-ring relative to the cap arrangement.

18. A container assembly comprising:

(a) a bottle including a top open end and a cylindrical top end section extending downwardly from said open end, said top end section being provided with external threads;

(b) a cap arrangement including means defining a cylindrical innermost surface containing internal threads which are designed to cooperate with said external threads for screwing down the cap arrangement around the top end section of said bottle for closing its open end, said cap arrangement also including an underside extending across and above said innermost surface;

(c) means for locating said cap arrangement in a predetermined closed position along the length of the top section of said bottle; and (d) means for providing a seal around the open end of said bottle between the latter and said cap arrangement when said cap arrangement is in said predetermined closed position, said seal providing means including a resilient O-ring and seal means located over the open end of said bottle supporting said O-ring above said opened end such that the O-ring engages the underside of said cap arrangement when the latter is in said predetermined closed position in order to cause said seal means to seal closed said open end, said O-ring being dimensioned to engage said underside to provide said sealing even if said cap arrangement is in a position around the top end section of said bottle predetermined distances above and below said predetermined closed position, said seal means supporting said O-ring and said cap arrangement include cooperating means for interlocking said seal means and the supported O-ring to said cap arrangement when the latter is separated from said bottle.

* * * * *

UNITED STATES PATENT AND TRADEMARK OFFICE

CERTIFICATE OF CORRECTION

PATENT NO. : 4,310,101

DATED : January 12, 1982

INVENTOR(S) : Shigeo Sekine

It is certified that error appears in the above-identified patent and that said Letters Patent are hereby corrected as shown below:

On The Title Page item (73) should read

--[73] Assignee: Max Factor & Company, Hollywood, California and Kabushiki Kaisha Yoshino Kogyo-Sho, Tokyo, Japan--

On The Title Page insert;

--[30] Foreign Application Priority Data
March 5, 1979 Japan..... 54-27765 --.

Signed and Sealed this

Eleventh Day of May 1982

[SEAL]

Attest:

GERALD J. MOSSINGHOFF

Attesting Officer

Commissioner of Patents and Trademarks